US008622269B2

(12) United States Patent
Hogue

(10) Patent No.: US 8,622,269 B2
(45) Date of Patent: Jan. 7, 2014

(54) HANDGUN HOLSTER FOR CONCEALED CARRY

(76) Inventor: Mark W Hogue, Austin, TX (US)

( * ) Notice: Subject to any disclaimer, the term of this patent is extended or adjusted under 35 U.S.C. 154(b) by 349 days.

(21) Appl. No.: 13/184,557

(22) Filed: Jul. 17, 2011

(65) Prior Publication Data

US 2013/0015225 A1 Jan. 17, 2013

(51) Int. Cl.
*F41C 33/02* (2006.01)

(52) U.S. Cl.
USPC ..... 224/587; 224/912

(58) Field of Classification Search
USPC ..... 224/587, 237, 238, 912
See application file for complete search history.

(56) References Cited

U.S. PATENT DOCUMENTS 4,113,157 A * 9/1978 Woodbury ..... 224/163
4,466,537 A 8/1984 McMahan
4,966,320 A 10/1990 DeSantis et al.
5,294,031 A 3/1994 Volpei et al.
5,967,393 A 10/1999 Clarke, III
6,112,959 A * 9/2000 Townsend ..... 224/153
6,695,186 B2 * 2/2004 Madarang ..... 224/587
8,328,058 B2 * 12/2012 Wilson ..... 224/625
8,371,487 B1 * 2/2013 Plappert ..... 224/193
8,381,953 B2 * 2/2013 Vennemeyer ..... 224/192
2004/0217141 A1 * 11/2004 Brooks ..... 224/587
2009/0218379 A1 9/2009 Harris et al.

* cited by examiner

*Primary Examiner* — Justin Larson
(74) *Attorney, Agent, or Firm* — Taylor Russell & Russell, P.C.

(57) ABSTRACT

A holster for concealed handgun carry that relies on the façade of a cell phone or cell phone case, and which relies on actuated hinges for securing moveable panels. Spring loaded hinges may be used for providing opening of the hinged panels of the holster, providing access by the wearer to the handgun contained within the holster. Latching of a closed configuration may be accomplished by a snap, hook and loop fasteners and magnetic fasteners. Access to a handgun contained within the holster may be accomplished with minimal movement of an arm, hand or finger.

20 Claims, 5 Drawing Sheets

HANDGUN HOLSTER FOR CONCEALED CARRY

BACKGROUND

In many jurisdictions, off-duty police officers are required or permitted to carry a handgun that is in some way concealed from the view of others who may be in proximity to the officers. This is particularly important to those who may be working "under cover." Many of these officers may also wish to carry a concealed handgun in addition to the service weapon normally worn whale on duty. In addition, many states have enacted "right to carry" laws that permit a resident to carry a concealed handgun providing the resident has taken a prescribed handgun safety course, has no criminal record, has no outstanding restraining orders imposed by a court of law, and has passed a background check. Many states may not permit persons within the state to openly carry a handgun in public places.

Concealing a handgun may be accomplished by hiding it from view of others within a person's clothing or garments. While being hidden beneath layers of clothing may accomplish concealment, it may also make it difficult for the user to access the handgun expeditiously when confronted by danger. An example of this method of concealment is a shoulder holster carried beneath an armpit and covered with a jacket. Another example is a holster attached to a lower part of a leg. Both of these examples may limit the speed with which a user can access the handgun. Even a holster worn inside a belt and pant waist may require some form of clothing to conceal the presence of a handgun, such as having to wear a shirt tail outside the pants, which may make quick access difficult.

Another method of concealing a handgun is to enclose it within an article that appears to be something other than a holster for a handgun. The exterior façade may appear to be a carrying case for a mobile phone or pager. It may also be a fanny pack, bi-fold wallet or pouch used when hiking or participating in similar sporting activities. These implementations typically rely on mechanical snaps, zippers and hook-and-loop type fasteners to close an opening used to access the firearm, and usually require the use of two hands or extensive movements of the hands and arms. These enclosing devices may impede access to a handgun when it becomes necessary to access it quickly.

Although many new handgun designs have been dramatically reduced in size, thereby making it easier to conceal, prior art methods described in available literature for concealing a handgun are still encumbered with poor concealment and difficulty of quick access when required.

SUMMARY

The following disclosure describes a handgun holster for concealed carry that relies on a façade of a cell phone, or a cell phone case with spring-loaded hinges securing moveable panels. It is a compact design that can be worn on the street when dressed in casual clothes or in an office setting when wearing more formal work clothes without drawing attention to the fact that the wearer is carrying a handgun. Although it may rely on a snap or hook-and-loop material, another embodiment using a single magnetic latch on the front or rear edge of a spring-loaded panel is advantageous for rapid acquisition of the handgun. Under this embodiment, springs may be released for providing opening of the holster by simply pressing inward on a side panel, which breaks the magnetic force holding the release springs.

The handgun holster is designed to fit inside the waistband in front of a side pocket close to a draw hand. Being free of material, zippers or straps, it enables a clean grip of the handgun yet allows for quick access that may be accomplished with the flip of a finger. Access is provided whether a user is standing or sitting, allowing ready access even while sitting in a vehicle.

The holster includes spring-loaded hinged panels that appear to be a cell phone case when closed. When unlatched, the hinged panels spring open to be flush against the body of the user, allowing unimpeded access to the handgun held within the holster pocket, wherein the handgun may be quickly drawn and ready for use. Access is provided with minimal movement of an arm, a hand or even just a finger. A waistband clip may be provided to safely secure the holster containing a handgun inside the waistband of a user while holding the holster securely in place while the gun is withdrawn.

This Summary is provided to introduce a selection of concepts in a simplified form that are further described below in the Detailed Description. This Summary is not intended to identify key features or essential features of the claimed matter, nor is it intended to be used to limit the scope of the claimed subject matter.

BRIEF DESCRIPTION OF THE DRAWINGS

These and other features, aspects and advantages of the present invention will become better understood with regard to the following description and accompanying drawings wherein.

DETAILED DESCRIPTION

For reference purposes, Table 1 below provides reference designator identification for the components of embodiment of the disclosed holster.

TABLE 1

| REFERENCE DESIGNATOR IDENTIFICATION | |
|---|---|
| 100 | View of Holster in a Stand-Alone and Attached Configuration |
| 110 | Hinged Butt Panel |
| 120 | Hinged Top Panel |
| 130 | Hinged Front Panel |
| 140 | Fixed Hammer Panel |
| 150 | Waistband Clip |
| 160 | Holster Pocket |
| 180 | Back Panel First Version |
| 185 | Back Panel Second Version |
| 190 | Garment |
| 195 | Waistband or Belt |
| 200 | Sequential Snapshot Views of a Holster Opening |
| 210 | Second Fastening Means |
| 215 | First Fastening Means |
| 220 | First Actuating Hinge |
| 230 | Second Actuating Hinge |
| 300 | Perspective View of Completely Open Holster |
| 310 | Third Actuating Hinge |

TABLE 1-continued

| REFERENCE DESIGNATOR IDENTIFICATION | |
|---|---|
| 320 | Outline of a Handgun Butte, Handgrip and Hammer |
| 400 | Backside View of Handgun Holster |
| 410 | Fasteners |
| 500 | View of a Second Holster Embodiment |

Figure 1B:
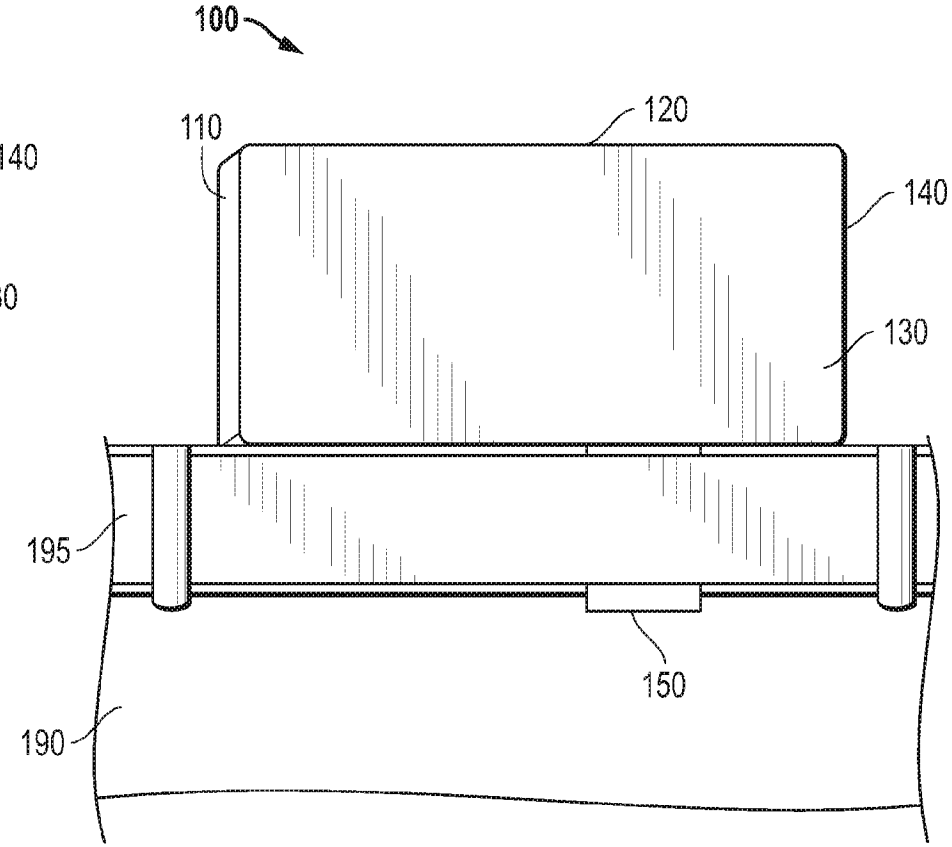
FIG. 1 is a perspective view of an embodiment of a handgun holster closed for concealed carry.
Figure 1A:
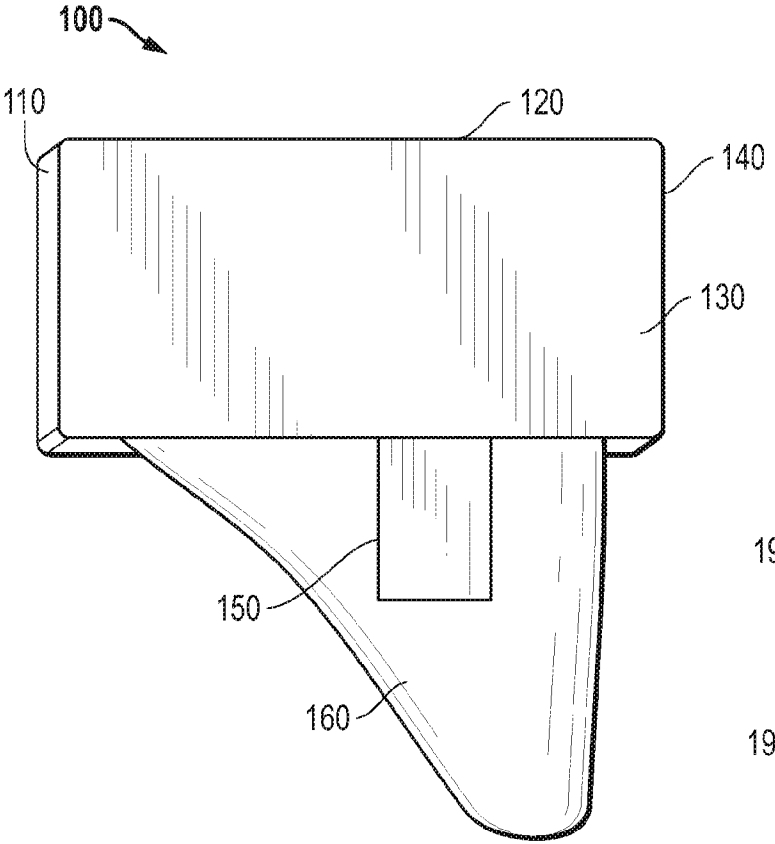
Figure 4B:
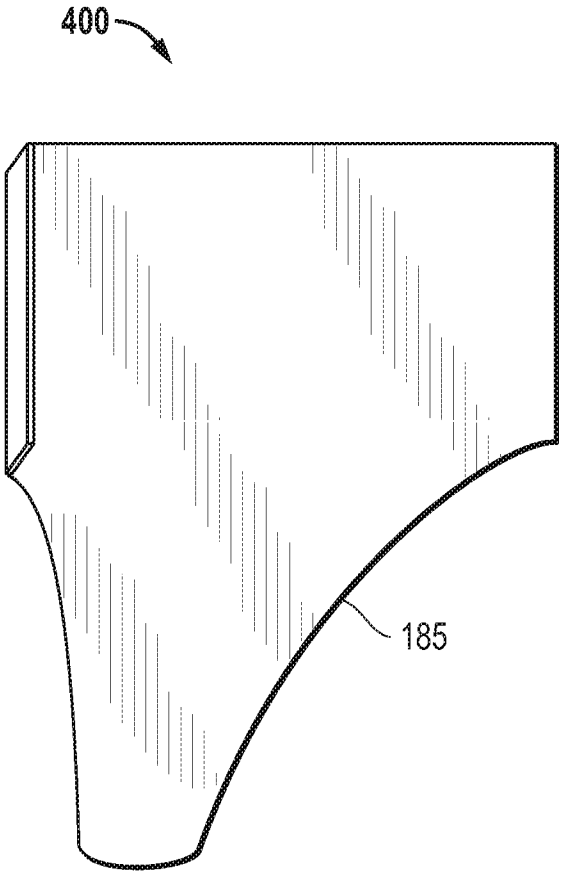
FIG. 4 illustrates embodiments of a back side of a handgun holster.

The detailed description is directed to a handgun holster apparatus for a person desiring to carry a handgun concealed from view of others. FIG. 1 is a perspective view 100 of an embodiment of a handgun holster closed for concealed carry. FIG. 1A shows the holster in a stand-alone configuration. It includes a hinged butt panel 110 (in reference to the side of the holster where the butt of the gun's handle is positioned), a hinged top panel 120 and a hinged front panel 130. These hinged panels are preferably spring-loaded for fast access to an enclosed handgun when released. A fixed hammer panel 140 (in reference to the side of the holster where the hammer of the gun is positioned) is rigidly positioned to a back panel of the holster 180 (shown in FIG. 2E) opposite the hinged front panel 130. A holster pocket 160 is provided to hold a handgun securely until deployment, and is attached to the back panel 180 as shown in FIG. 4. A waistband clip 150 is provided to secure the holster to a waistband or belt 195 of a garment 190. FIG. 1B shows the holster attached by a waistband clip 150 to a waistband or belt of a garment 190 worn by an individual.

FIG. 2A-FIG. 2E illustrates sequential snapshots of a butt-side panel 110 view. Not shown is a handgun positioned within the holster pocket 160 shown in FIG. 1A. The hinged front panel 130 is secured in a closed position by a first fastening means 215 attached to the hinged front panel 130 and a second fastening means 210 attached to the hinged butt panel 110. The hinged front panel 130 is attached to the hinged top panel 120 by a first spring-actuated hinge 220. Similarly, the hinged top panel 120 is attached to the back panel 180 by a second spring-actuated hinge 230.

Figures 2A, 2B, 2C, 2D, 2E:
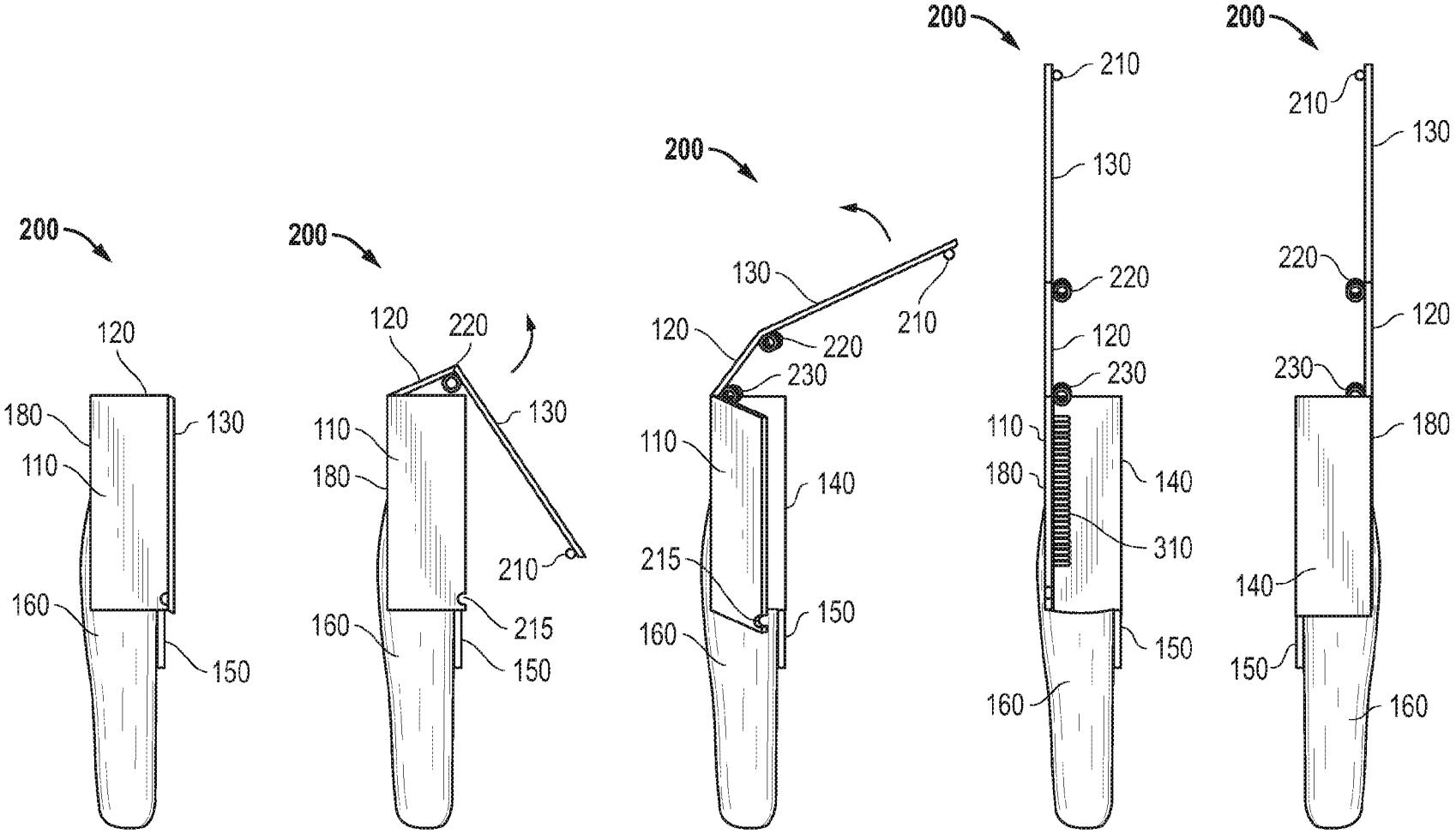
FIG. 2A-FIG. 2E illustrate sequential snapshots of an embodiment of a handgun holster opening.

FIG. 2B and FIG. 2C shows progressive snapshots of the hinged front panel 130 and the hinged top panel 120 opening under the force of the first and second spring-actuated hinges 220, 230 when the user releases the fastening means 210, 215 with a press or pull of a finger. The front panel 130 rotates about an axis of the first actuating hinge 220 and the top panel 120 rotates about the axis of the second actuating hinge 230.

FIG. 2D illustrates a butt-side panel 110 view of the holster fully opened, with the first and second spring-actuated hinges 220, 230 shown in a fully opened position. The sequence of snapshots shown between FIG. 2A and FIG. 2D occurs very quickly under force of the first and second spring-actuated hinges 220, 230 when the fastening means 210, 215 is released by the user. The configuration shown in FIG. 2D enables a user to quickly access a handgun cradled in the holster pocket. FIG. 2E illustrates a hammer side panel 140 view of the holster fully opened, with the first and second spring-actuated hinges 220, 230 shown in a fully opened position.

Figure 3B:
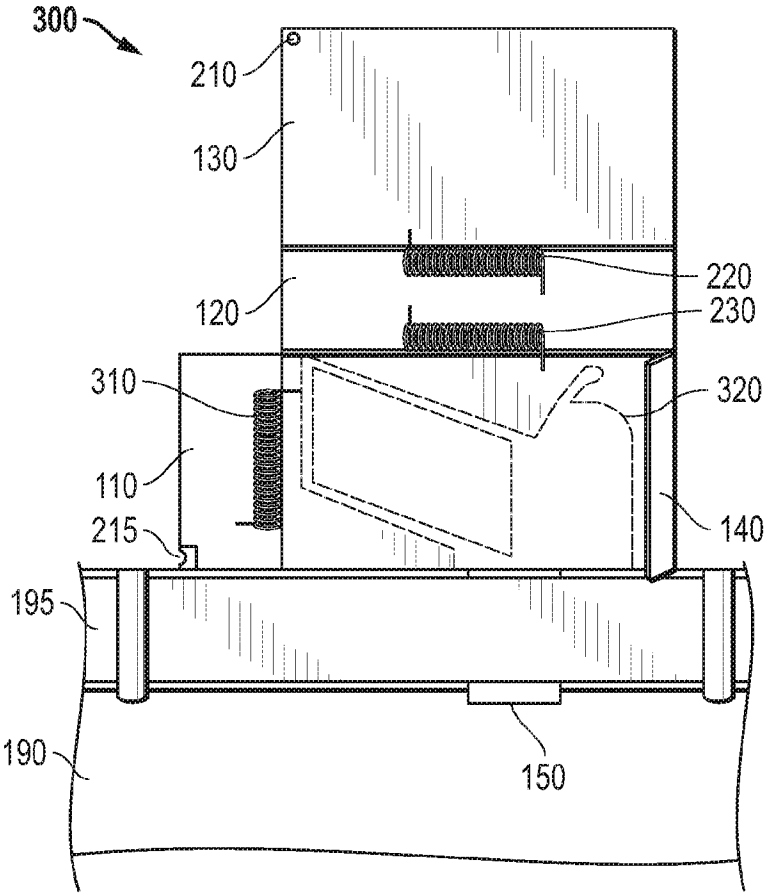
FIG. 3 is a perspective view of an embodiment of a handgun holster in a completely open state.
Figure 3A:
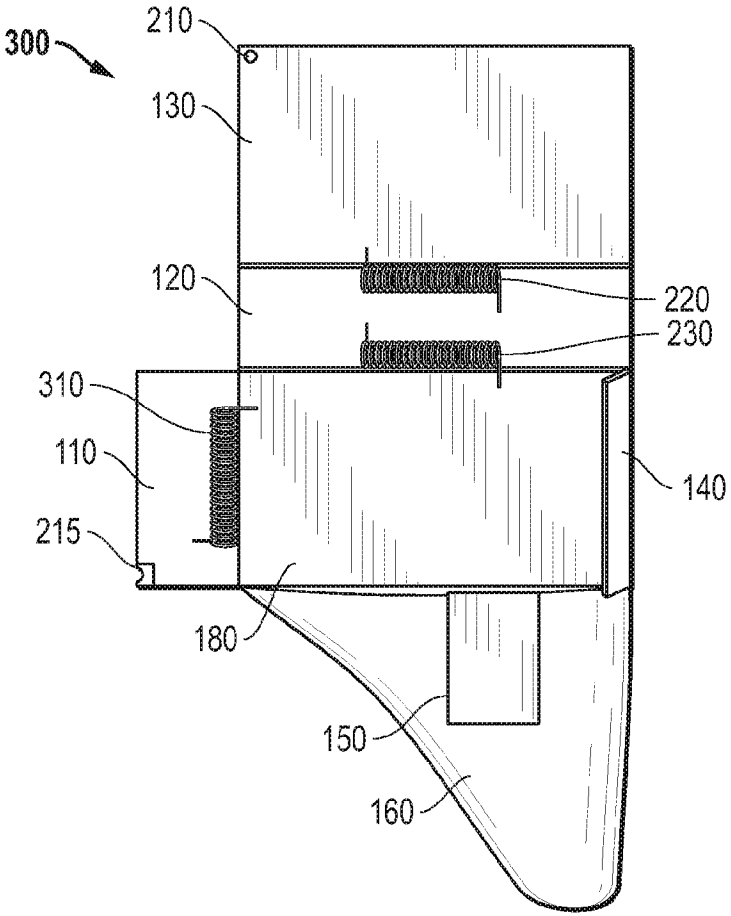

FIG. 3 is a perspective view of an embodiment of a handgun holster in a completely open state or accessible configuration. FIG. 3A shows the holster in a stand-alone and open configuration. It includes a hinged butt panel 110, a hinged top panel 120 and a hinged front panel 130. As noted above, these hinged panels are preferably spring-loaded for fast access to an enclosed handgun when fastening means 210, 215 is released. A fixed hammer panel 140 may be rigidly positioned to a back panel of the holster 180, or may be connected by a spring-actuated hinge to the back panel 180, similar to a third spring-actuated hinge 310 connecting the butt panel 110 to the back panel 180. A holster pocket 160 is provided to hold a handgun when the holster is in a closed or concealed configuration as shown in FIG. 1A and FIG. 1B, and an open or accessible configuration, as shown in FIG. 3A and FIG. 3B. A waistband clip 150 is provided to secure the holster to a waistband or belt 195 of a garment 190, as shown in FIG. 3B. FIG. 3B shows the holster attached by a waistband clip 150 to a waistband or belt of a garment 190 worn by an individual. FIG. 3A also shows the first fastening means 215, the second fastening means 210 and the first, second and third spring-actuated hinges 220, 230, 310. Similarly to the operation of the spring-actuated hinges 220, 230 described above, when the user releases the first fastening means 215 and second fastening means 210, the third spring-actuated hinge 310 causes the hinged butt panel 110 to quickly swing open. This action coupled with the simultaneous actions of panels 130, 120, as described above, enables access to an enclosed handgun. The fastening means may be a snap fastener, hook-and-loop fastener or a magnetic fastener. For reference purposes, the outline 320 of the butt, the handgrip and the hammer portion of a handgun is shown as dashed lines in FIG. 3B.

Figure 4A:
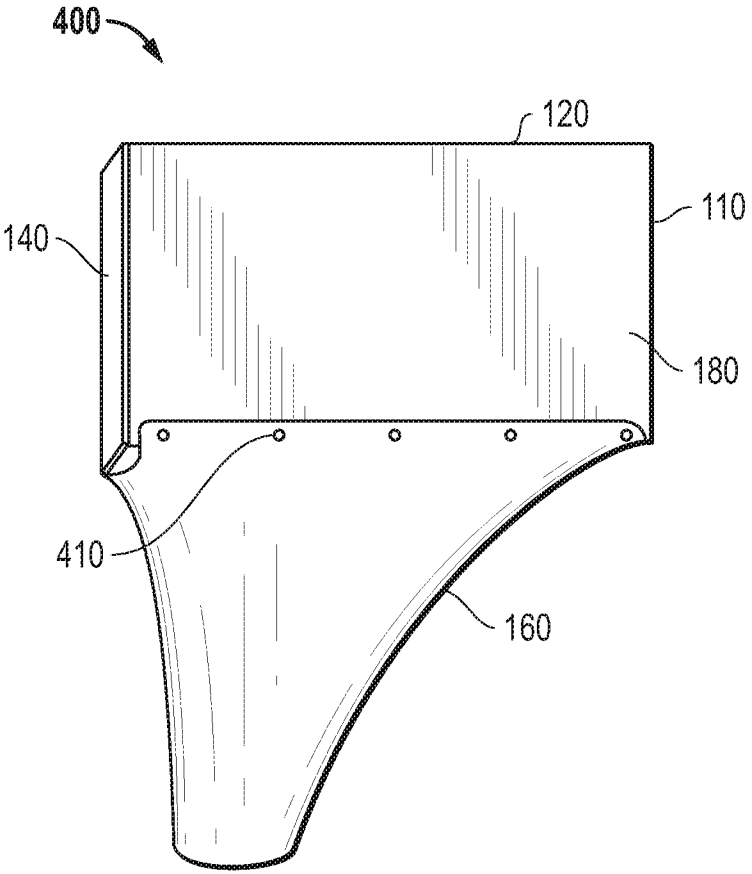

FIG. 4 illustrates embodiments of a back side 400 of a handgun holster. The purpose of the back side is to rigidly position the connecting second and third hinges 230, 310 and top portion of a holster pocket 160, while conforming to the shape of the body of a user and protecting user's clothing from gun oil. FIG. 4A illustrates a configuration whereby the back panel 180 and the holster pocket 160 are separate pieces held together by fasteners 410. The back panel 180 is rigid but the holster pocket 160 is typically fabricated from leather, fabric or extruded synthetic material. FIG. 49 illustrate a second embodiment of a back panel 185 that is a single fabricated piece of leather or synthetic material. The second embodiment of the back panel 185 may also be an integral part of a completely extruded handgun holster for concealed carry.

Figure 5:
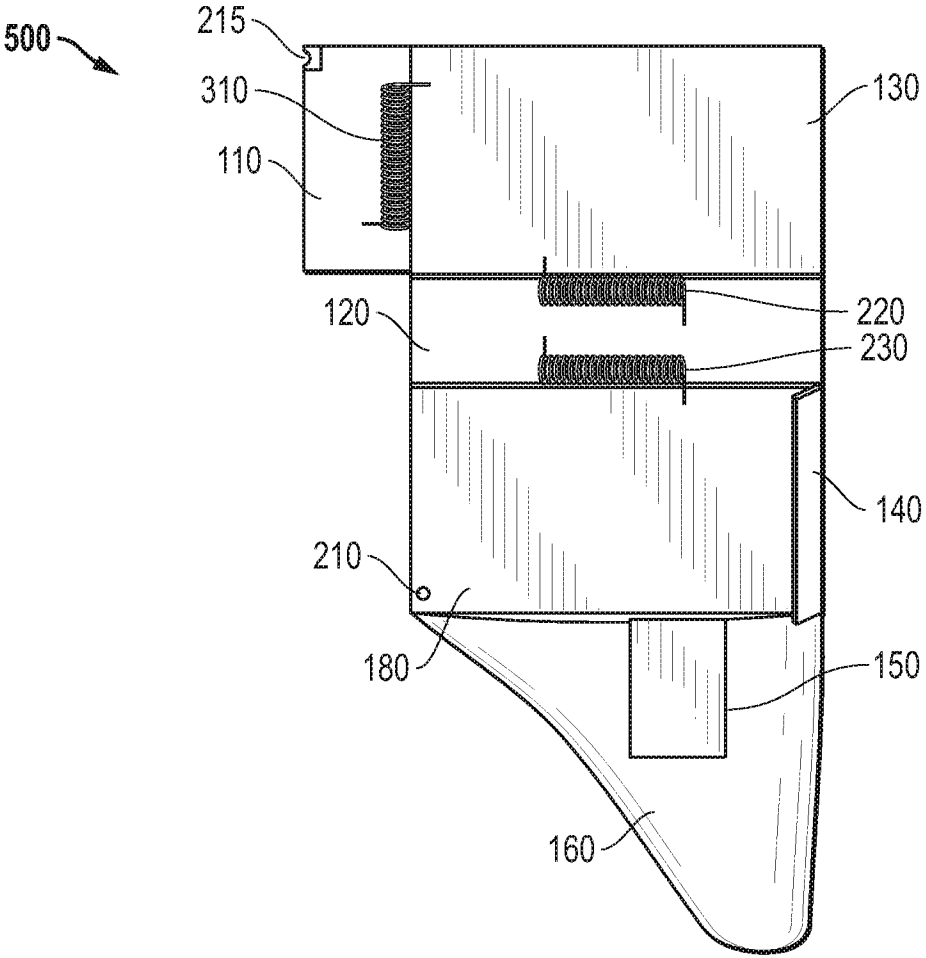
FIG. 5 illustrates an alternate placement of one of the panels.

FIG. 5 illustrates another embodiment of the holster, whereby the butt panel 110 may be attached via a third spring-actuated hinge 310 to the front panel 130 instead of to the back panel 180. This may provide for smoother motion of releasing the fastened means while continuing to move the hand toward the pistol because the user's finger would not have to reverse direction to move out of the way of the swinging panel after releasing the fastening means. The butt panel 110 would then immediately begin springing upward and away from the hand as it opens, as shown in FIG. 5.

Although the subject matter has been described in language specific to structural features and methodological acts, it is to be understood that the subject matter defined in the appended claims is not necessarily limited to the specific features or acts described above. Rather, the specific features and acts described above are disclosed as example forms of implementing the claims.

What is claimed is:

1. A handgun holster for concealed carry, comprising:

a back panel fastened to a holster pocket;

a butt panel connected to the back panel by a third actuating hinge;

a top panel connected to the back panel by a second actuating hinge;

a front panel connected to the top panel by a first actuating hinge;

a hammer panel affixed to the back panel at about a right angle; and a first and second fastening means for maintaining the hinged butt panel, top panel and front panel in a closed configuration relative to the back panel for concealing a handgun within the holster pocket.

2. The holster of claim 1, further comprising a means for releasing the first and second fastening means whereby the hinged butt panel, top panel and front panel are released to an open configuration relative to the back panel for revealing and providing access to a handgun within the holster pocket.

3. The holster of claim 1, wherein the first, second and third actuating hinges are spring-actuated hinges.

4. The holster of claim 1, further comprising a waistband clip for securing the holster to a waistband.

5. The holster of claim 1, further comprising a waistband clip for securing the holster to a belt.

6. The holster of claim 1, wherein the back panel and holster pocket are a single fabricated component.

7. The holster of claim 1, wherein the back panel is an integral part of a completely extruded holster.

8. The holster of claim 1, wherein the holster material is selected from the group consisting of leather and synthetic material.

9. The holster of claim 1, wherein the butt panel is connected to the hinged front panel by the third actuating hinge.

10. The holster of claim 1, wherein a handgun is completely concealed from view when the first and second fastening means maintains the hinged butt panel, top panel and front panel in a closed configuration relative to the back panel.

11. The holster of claim 1, wherein a handgun is readily accessible by a wearer and viewable to others when the first and second fastening means are released enabling the hinged butt panel, top panel and front panel to pivot to an open configuration relative to the back panel.

12. A handgun holster for concealed carry comprising:

a back panel and holster pocket;

means for rotating a hinged butt panel between an open coplanar and a closed right angle relationship relative to the back panel;

means for rotating a hinged top panel between an open coplanar and a closed right angle relationship relative to the back panel;

means for rotating a hinged front panel between an open coplanar and a closed right angle relationship relative to the hinged top panel;

a fixed hammer panel positioned at about a right angle relationship to the back panel; and a first and second fastening means for maintaining a closed right angle relationship of the hinged butt panel and the hinged top panel relative to the back panel, and maintaining a closed right angle relationship of the hinged front panel relative to the hinged top panel.

13. The holster of claim 12 wherein the first and second fastening means enables the hinged butt panel, the hinged top panel and the hinged front to open to coplanar relationships with adjoining hinged surfaces.

14. The holster of claim 12, wherein the means for rotating the hinged butt panel, the hinged top panel and the hinged front panel are spring-actuated hinges.

15. The holster of claim 12, wherein the back panel and holster pocket are a single fabricated component.

16. The holster of claim 12, wherein the back panel is an integral part of a completely extruded holster.

17. The holster of claim 12, wherein the holster material is selected from the group consisting of leather and synthetic material.

18. The holster of claim 12, wherein the butt panel is connected to the hinged front panel by an actuating hinge.

19. The holster of claim 12, wherein a handgun is completely concealed from view when the first and second fastening means maintains the hinged butt panel, top panel and front panel in a closed right angle relationship.

20. The holster of claim 12, wherein a handgun is readily accessible by a wearer and viewable to others when the first and second fastening means are released enabling the hinged butt panel, top panel and front panel to hinge to an open coplanar relationship.

* * * * *